US008195381B2

(12) United States Patent
Arvidsson

(10) Patent No.: US 8,195,381 B2
(45) Date of Patent: Jun. 5, 2012

(54) SAFETY SYSTEM FOR MARINE VESSELS

(75) Inventor: Lennart Arvidsson, Kållered (SE)

(73) Assignee: AB Volvo Penta, Göteborg (SE)

( * ) Notice: Subject to any disclaimer, the term of this patent is extended or adjusted under 35 U.S.C. 154(b) by 388 days.

(21) Appl. No.: 12/447,659

(22) PCT Filed: Nov. 30, 2006

(86) PCT No.: PCT/SE2006/001374
§ 371 (c)(1),
(2), (4) Date: Apr. 29, 2009

(87) PCT Pub. No.: WO2008/066422
PCT Pub. Date: Jun. 5, 2008

(65) Prior Publication Data

US 2009/0276148 A1 Nov. 5, 2009

(51) Int. Cl.
*G06F 17/00* (2006.01)

(52) U.S. Cl. ..... 701/116; 701/21

(58) Field of Classification Search ..... 701/21, 701/116; 441/80; 440/1, 6; 340/576.6, 57.6, 340/984–986.3
See application file for complete search history.

(56) References Cited

U.S. PATENT DOCUMENTS 5,029,293 A * 7/1991 Fontanille ..... 340/573.1
5,326,297 A * 7/1994 Loughlin ..... 441/89
5,386,368 A 1/1995 Knight
5,488,361 A * 1/1996 Perry ..... 340/984
5,491,636 A * 2/1996 Robertson et al. ..... 701/116
6,183,328 B1 * 2/2001 Marshall ..... 441/89
7,023,338 B1 * 4/2006 Foth ..... 340/539.13
7,105,800 B1 9/2006 Staerzl
2002/0052159 A1 5/2002 Eguchi

FOREIGN PATENT DOCUMENTS

DE 19503829 A1 8/1996
GB 2336928 A 11/1999
WO 9528682 A1 10/1995

* cited by examiner

*Primary Examiner* — Paul N Dickson
*Assistant Examiner* — Robert A Coker
(74) *Attorney, Agent, or Firm* — WRB-IP LLP

(57) ABSTRACT

There is elucidated a safety system for a marine vessel. The vessel includes two engines coupled to propellers for propelling the vessel through water. The vessel is provided with a digital anchor in communication with the two engines for maintaining the vessel substantially at a defined location when the anchor is activated. The safety system includes a sensor assembly coupled to a data processing assembly for sensing a region of said water at least partially surrounding the vessel for detecting one or more persons present in the region and for modifying operation of the digital anchor is response to the one or more persons being detected. The invention is of advantage in that the digital anchor is capable of responding to the one or more persons being present in the water and thereby reducing a risk of injury or loss of life when the digital anchor is employed.

25 Claims, 6 Drawing Sheets

SAFETY SYSTEM FOR MARINE VESSELS

BACKGROUND AND SUMMARY

The present invention relates to safety systems for marine vessels, for example to safety systems for marine vessels operable to employ digital anchors to actively maintain the vessels in position in marine environments. Moreover, the present invention also relates to methods of providing such safety systems. Furthermore, the present invention also concerns software products executable on computing hardware for implementing such safety systems.

Apparatus for maintaining a marine vessel, for example a boat, in a desired position in a marine environment are known. In a simplest implementation, such apparatus is implemented as a mechanical anchor coupled by rope and/or chain either directly to the vessel, or via a winch arrangement to the vessel. This simplest implementation is useful in situations wherein water depth is not excessive, a sea or lake bed is of nature that the anchor can reliably grip onto the bed, and there is sufficient time or desire to deploy the anchor. More recently, it has been found beneficial to implement the apparatus actively wherein a desired position is maintained by actively propelling the vessel to the desired position determined by way of an absolute reference, for example Global Positioning System (GPS); the active implementation of the apparatus is conveniently referred to as being a "digital anchor". Digital anchoring is employed in large marine vessels, for example oil drilling and production platforms for maintaining their drilling or wellhead positions accurately, as well as in small boats such as fishing boats.

In a published U.S. Pat. No. 5,386,368, there is described an apparatus for maintaining a marine vessel, for example a boat, in a desired position. The apparatus includes an electric trolling motor disposed to produce a thrust to pull the vessel, a steering motor disposed to affect the orientation of the electric trolling motor, a position deviation detection unit, and a control circuit. The position deviation detection unit is operable to detect a deviation in the position of the marine vessel from the desired position and also to transmit signals indicative of a deviation distance and a return heading to the control circuit; the "deviation distance" is defined as the distance from the marine vessel to the desired position, and the "return heading" is defined as the direction of the desired position from the marine vessel. The control circuit is operable to cause the steering motor to steer the electric trolling motor in a return heading in order to return the marine vessel to the desired position. In a first implementation of the apparatus described, the position deviation detection unit detects a deviation in position of the marine vessel based on GPS signals. Alternatively, in a second implementation, the position deviation detection unit detects a deviation in position of the marine vessel based on signals received from an anchored transmitter, for example provided from transmitters located in one or more buoys. Yet alternatively, in a third implementation, the position deviation detection unit detects a deviation is position based on forces caused by surrounding water when the marine vessel drifts.

In an international PCT patent application No. PCT/US95/04807 (WO 95/28682), there is described an anchorless boat positioning system which is operable to dynamically and automatically maintain a boat at a selected anchoring location within water without using a conventional anchor; the positioning system employs a steerable thruster whose thrust and steering direction are determined on the basis of position information signals received from GPS satellites and heading indication signals generated by a magnetic compass. The anchorless positioning system is operable to continuously monitor the position and heading of the boat and to compare the position and heading with stored coordinates of the selected anchoring location to generate control signals for controlling the steerable motor.

Whereas conventional mechanical anchors are susceptible to losing their spatial position in a marine environment by way of unsatisfactory grip to a sea or lake bed, digital anchors are susceptible to also losing accuracy in, for example, one or more of the following circumstances:

(a) a GPS reference becomes unreliable, for example adverse weather conditions degrade or interrupt GPS signal reception from GPS satellites;

(b) a GPS receiver failure occurs or an associated propulsion arrangement becomes unreliable, for example an engine stalls or a rudder becomes jammed in a given position; and (c) a control system failure occurs, wherein the control system which is normally operable to drive an error between a desired position of the marine vessel within the marine environment relative to the measured GPS spatial position of the vessel to substantially zero is subject to failure, for example a computer system crashes and needs to be restarted.

Failure of digital anchors is thus susceptible to resulting in potentially dangerous situations, for example a person sails alone in a mariner vessel equipped with a digital anchor and then subsequently activates the anchor at a given location whilst temporarily leaving the marine vessel, for example for deploying fishing nets or for performing an off-boat task such as diving reconnaissance. In such a situation, the marine vessel is potentially unmanned such that failure of the digital anchor risks leaving the person stranded far out at sea. A conventional approach to reduce a risk of such failure is to improve integrity of the digital anchor, for example by duplicating or triplicating critical functional components of the digital anchor, or to employ a conventional anchor.

Thus, a technical problem addressed by aspects of the present invention is to improve operating safety of digital anchors, for example in a situation wherein a marine vessel is unmanned whilst its digital anchor is invoked into operation.

It is desirable to provide a safety system for marine vessels which is susceptible to improving user-safety of digital anchors.

According to a first aspect of the present invention, there is provided a safety system for a marine vessel, the vessel including one or more engines coupled to one or more propellers for propelling the vessel through water, and the vessel being provided with a digital anchor in communication with the one or more engines for maintaining the vessel substantially at a defined location when the anchor is activated, characterized in that the safety system includes a sensor assembly coupled to a data processing assembly for sensing a region of the wafer at least partially surrounding the vessel for detection of one or more persons present in the region and for modifying operation of the digital anchor is response to the one or more persons being detected.

The invention is of advantage, in an aspect thereof, in that the digital anchor is capable of responding to the one or more persons being present in the water and thereby reducing a risk of injury or loss of life when the digital anchor is employed.

Optionally, in the safety system, the system is operable to respond to the detection of the one or more persons by one of more of:

(a) deactivating the digital anchor;

(b) operating the engines so as to maintain the vessel in a proximity of the one or more persons;

(c) deactivating drive to the engines in an event that the one or more persons are closer to the propellers than a threshold distance.

Thus, the safety system is capable of reducing injury to the one or more persons by way of propellers of the vessel being driven to implement a digital anchor function in a more appropriate manner.

Optionally, in the safety system, the sensor assembly includes one or more infra red sensors for detecting infra red radiation generated by the one or more persons when present in the region of the water. Infra red sensors are of benefit in that they are capable of providing a most reliable signal indicative of a presence of the one or more persons in the region of the water.

More optionally, in the safety system, each of the one or more infra red sensors are scanned and/or pixellated image sensors operable to generate an output signal (Ci,j) for receipt at the data processing assembly representative of a spatial image of at least a portion of the region of water. Employing pixellated sensors provides the one or more sensors with spatial discrimination which is beneficial for more reliably detecting the presence of the one or more persons in the region of the water.

Optionally, in order to exclude interfering extraneous radiation at a human visible portion of the electromagnetic spectrum when employing the safety system, the one or more sensors are responsive in an electromagnetic radiation wavelength range of substantially 10 μm to 800 nm, more preferably in a wavelength range of 5 μm to 1 μm.

Optionally, to remove angular motion of the vessel from adversely affecting detection of the one or more persons in the region of the water, one or more sensors in the safety system are angularly stabilized for rendering the output signal (Ci, j) compensated for angular movement of the vessel relative to the water.

More optionally, in the safety system, the one or more sensors are mounted on one or more gyroscopically angularly stabilized servo-platforms in order to remove affects of angular motion of the vessel relative to the water from the aforesaid output signal (Ci, j).

Optionally, in the safety system, the data processing assembly is provided with computing hardware for computing a moving average for each spatial region of the image and for detecting differences in the moving average for detecting the presence of the one or more persons within the region of water. Computation of a moving average is a most reliable approach to detecting a presence of the one or more persons in the water in comparison to neural network-type detection or template comparison detection which are also within the scope of the present invention.

More optionally, in the safety system, the differences are compared with a threshold value for determining detection of the one or more persons in the region of water.

Optionally, in the safety system, the processing assembly is operable to compute the moving average with spatial averaging and/or temporal averaging which is varied in response to one or more of:

(a) solar irradiation onto the vessel and the region of water surrounding the vessel; (b), amplitude of wave motion in the region of water;

(c) wind speed at the vessel; and (d) temperature of the region of water.

Modifying operation of the safety system in response to prevailing weather conditions is potentially capable of increasing reliability of detection of the one or more persons in the water.

More optionally, in the safety system, the processing assembly is operable to vary the threshold value in response to one or more of:

(a) solar irradiation onto the vessel and the region of water surrounding the vessel;

(b) amplitude of wave motion in the region of water;

(c) wind speed at the vessel; and (d) temperature of the region of water.

In order to provide greater detection contrast relative to the water, in the safety system, each of the one or more persons are provided with one or more pulsed infra red sources attached thereto, the pulsed infra fed sources being operable in water to emit pulsed infra red radiation bearing a signature code which is detectable at the one or more sensors and subsequently correlatable at the signal processing assembly to provide for more reliable detection of the one or more persons present in the region of water.

More optionally, in the safety system, the one or more pulsed infra red sources are automatically activated in response to contact with the water.

According to a second aspect of the present invention, there is provided a life vest attachable to a person, the vest for use with the safety system pursuant to the first aspect of the invention, the vest including brie or more pulsed infra red sources attached thereto, the pulsed infra red sources being operable in water to emit pulsed infra red radiation bearing a signature code which is correlated at the signal processing assembly to provide for more reliable detection of the one or more persons present in the region of water.

According to a third aspect of the present invention, there is provided a head assembly attachable to a person, the head assembly for use with the safety system pursuant to the first aspect of the invention, the head assembly including one or more pulsed infrared sources attached thereto, the pulsed infra red sources being operable in water to emit pulsed infra red radiation bearing a signature code which is correlated at the signal processing assembly to provide for more reliable detection of the one or more persons present in the region of water.

According to a fourth aspect of the invention, there is provided a method of detecting one or more persons present in a region of water at least partially surrounding a, vessel, the vessel including one or more engines coupled to one or more propellers for propelling the vessel through water, and the vessel being provided with a digital anchor in communication with the one or more engines for maintaining the vessel substantially at a defined location when the anchor is activated, characterized in that the method includes steps of:

(a) using a sensor assembly coupled to a data processing assembly for sensing the region of the water for detecting, one or more persons present in the region; and (b) modifying operation of the digital anchor in response to the one or more persons being detected by the data processing assembly.

Optionally, the method includes a step of responding to the detection of the one or more persons by one or more of:

(a) deactivating the digital anchor;

(b) operating the engines so; as to maintain the vessel in a proximity of the one or more persons; and (c) deactivating drive to the engines in an event that the one or more persons are closer to the propellers than a threshold distance.

Optionally, in the method, the sensor assembly includes one or more infra red sensors for detecting infra red radiation generated by the one or more persons when present in the region of the water.

Optionally, in the method, each of the one or more infra red sensors are scanned and/or pixellated image sensors operable to generate an output signal (Ci, j) for receipt at the data processing assembly representative of a spatial image of at least a portion of the region of water.

More optionally, in the method, the one or more sensors are responsive in an electromagnetic radiation wavelength range of substantially 10 μm to 800 nm, more preferably in an electromagnetic wavelength range of 5 μm to 1 μm.

Optionally, in the method, the one or more sensors are angularly stabilized for rendering the output signal (Ci, j) compensated for angular movement of the vessel relative to the water.

Optionally, in the method, the one or more sensors are mounted on one or more gyroscopically angularly stabilized servo-platforms for compensating in the output signal for angular movement of the vessel relative to the water.

Optionally, in the method, the data processing assembly is provided with computing hardware for computing a moving average for each spatial region of the image and for detecting differences in the moving average for detecting the presence of the one or more persons within the region of water.

More optionally, in the method, the differences are compared with a threshold value for determining detection of the one or more persons in the region of water.

Yet more optionally, in the method, the processing assembly is operable to compute the moving average with spatial averaging and/or temporal averaging which is varied in response to one or more of:

(a) solar irradiation onto the vessel and the region of water surrounding the vessel;

(b) amplitude of wave motion in the region of water, (c) wind speed at the vessel; and (d) temperature of the region of water.

Yet more optionally, in the method, the processing assembly is operable to vary the threshold value in response to one or more of:

(a) solar irradiation onto the vessel and the region of water surrounding the vessel;

(b) amplitude of wave motion in the region of water;

(c) wind speed at the vessel; and (d) temperature of the region of water.

Optionally, to further enhance operation of the method, the method includes steps of:

(a) providing each of the one or more persons with one or more pulsed infra red sources attached thereto, the pulsed infra red sources being operable in water to emit pulsed infra red radiation bearing a signature code detectable at the one or more sensors; and (b) correlating at the signal processing assembly the received signature code received from the one or more pulsed infra red sources to provide for more reliable detection of the one or more persons present in the region of water.

More optionally, in the method, the one or more pulsed infra red sources are automatically activated in response to contact with the water.

According to a fifth aspect of the invention, there is provided a software product executable on computing hardware to implement a method pursuant to the fourth aspect of the invention.

It will be appreciated that features of the invention are susceptible to being combined in any combination without departing from the scope of the invention as defined by the accompany claims.

DESCRIPTION OF THE DIAGRAMS

Embodiments of the present invention will now be described, by way of example only, with reference to the accompanying drawings wherein.

In the accompanying diagrams, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION

In overview, the present invention is concerned with safety systems for marine vessels equipped with digital anchors. The present invention relates to safety systems for use with digital anchors. The safety systems having:

(a) one or more additional sensors for sensing a separation distance between one or more persons in near vicinity to the marine vessel; and (b) an additional control unit in communication with the one or more sensors, wherein the control unit is coupled in communication with the digital anchor for selectively disabling the digital anchor in situations wherein the one or more persons are becoming increasingly spatially separated from the marine vessel and/or are entering a region surrounding the marine vessel wherein there is a risk of the one or more persons risk being injured by operation of propellers of the marine vessel when the digital anchor is in its active state.

Such a safety system, is potentially complex to implement in practice because a person swimming or submerged in water surrounding the marine vessel is potentially difficult to detect. Moreover, in an accident situation wherein a person falls unintentionally overboard whilst the digital anchor is in operation, the person may often be equipped with no more than a simple life vest. In more stormy weather conditions, the person may often be at least partially obscured by swell of waves and be struggling to keep his or her head above water level in an attempt to breath.

Figure 1:
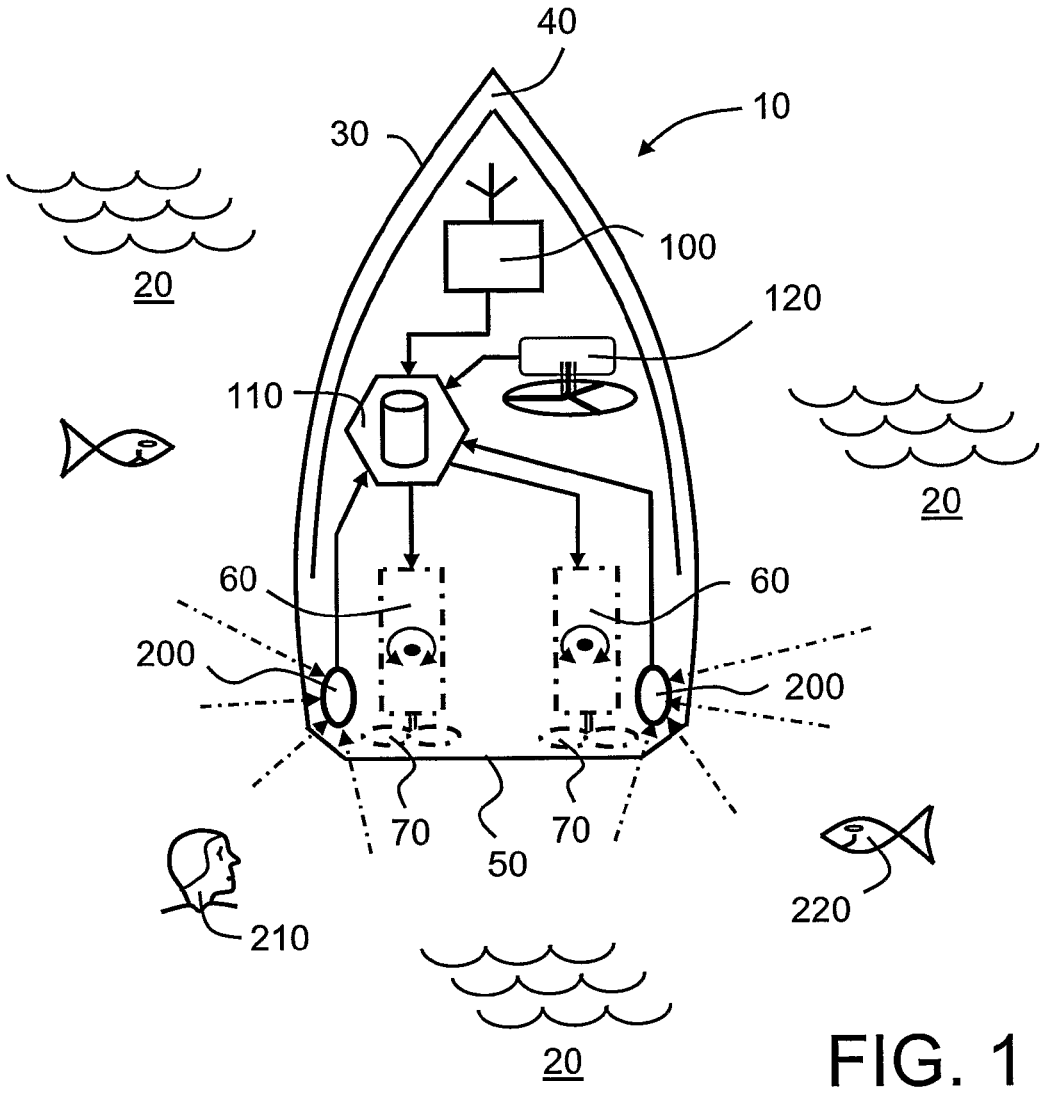
FIG. 1 is a schematic diagram of a vessel in water, wherein the vessel is provided with a digital anchor and a safety system pursuant to the present invention.

An embodiment of the invention will now be described with reference to FIG. 1. A marine vessel is indicated generally by 10 in a plan view, the plan view is directed towards an upper surface 20 of water on which the vessel 10 is operable to float. The vessel 10 is, for example, a boat, a yacht, a cargo vessel, a ferry, a barge or any other type of aquatic vehicle. Moreover, the vessel 10 includes a hull 30 including a tapered front end 40 and a truncated rear end 50 provided thereat with two engines 60 coupled to submersible propellers 70 for propelling the vessel 10 in the water 20. Within the vessel 10, there is mounted a global positioning system (GPS) 100 coupled to a control unit 11Q; the control unit 110 optionally includes computing hardware and/or digital hardware. Additionally, the vessel 10 further includes mounted therein a steering assembly 120 coupled to the control unit 110. Furthermore, the control unit 110 is also coupled to the two engines 60 for controlling their mechanical output power provided to the propellers 70 and a direction in which the propellers 70 are orientated in operation to propel the vessel through the water 20.

The vessel 10 additionally includes one or more sensors 200, for example two sensors 200, for sensing a region at least partially surrounding the vessel 10. In FIG. 1, the sensors 200 are shown mounted in substantially the rear end 50 of the vessel 10 to sense a region of the surface 20 behind the vessel 10 including the propellers 70. However, such sensors 200 are also optionally included towards and/or at the front end 40 of the vessel 10.

Operation of the vessel 10 will now be described in overview with reference to FIG. 1. In normal Operation, an operator of the vessel 10 applies commands to the steering assembly 120 to control a direction and speed of travel of the vessel 10, for example an angular heading, speed and reverse/forward travel of the vessel 10. Signals output from the steering assembly 120, for example communicated via a proprietary CAN-type data link, propagate to the control unit 110 which controls operation of the engines 60 and their angular orientation in response to the signals received at the control unit 110.

The vessel 10 is capable of being operated in a digital anchor mode wherein the operator of the vessel 10 enters a GPS coordinate at the steering assembly 120 indicative of a spatial position Pref and an angular orientation θref in the water 20 at which the vessel 10 is to be actively maintained by way of the digital anchor mode of operation. In the digital anchor mode of operation, the control unit 110 automatically operates the engines 60 so as to try to reduce to substantially zero a spatial error δP and angular error δθ between an actual position Psensed and actual sensed orientation θsensed of the vessel in comparison to the specified spatial position Pref and specified angular orientation θref respectively of the vessel 10.

A potentially danger arises when the aforesaid Operator 210 configures the vessel 10 to function in its digital anchor mode of operation and then the operator 210 proceeds, either deliberately or by accident, to enter into the water 20. In such a situation, the operator 210 is not able to control operation of the vessel 10. In an event of the digital anchor mode of operation of the vessel 10 becoming unreliable, for example the GPS system 100 failing to reliably receive signals from GPS satellites (not shown) due to external electromagnetic interference or malfunction of the system 100, the operator 210 potentially risks becoming stranded in the water 20 as the vessel 10 deviates from its desired spatial position and orientation in the water 20. Such a situation is potentially fatally dangerous when the vessel 10 is far out at sea.

An additional problem potentially arises, even with the aforementioned digital anchor mode of operation of the vessel 10 functioning reliably, with the operator 210 in the water 20 that currents and flow in the water 20 sweep the operator 210 into close proximity of the propellers 70 whereat the operator 210 risks injury in an event of the propellers 70 intermittently rotating to maintain the vessel 10 at the aforementioned desired spatial position and orientation by action of the aforesaid digital anchor.

In order to try to avoid injury to the operator 210 present in the water 20, or any other person that may happen to be in the water 20, the one or more sensors 200 are operable to sense a presence of the operator 210, or other people as appropriate, and generate corresponding surveillance signals which are communicated back to the control unit 110. In an event that the actual spatial position of the vessel 10 deviates by more than a threshold distance from the operator 210, the control unit 110 is operable to steer the vessel 10 towards the operator 210 so that the operator 210 is potentially capable of climbing back onto the vessel 10 to assume control thereof. Moreover, optionally, if the operator 210 swims within a dangerous vicinity of the propellers 70, the control unit 110 hinders operation of the propellers 70. Alternatively, in the event that the vessel 10 deviates by more than the threshold distance from the operator 210, the control unit 110 is optionally configurable to disable the aforementioned digital anchor mode of operation of the vessel 10.

Sensing a presence of the operator 210 in the water 20 is potentially a challenging task. The operator 210 is potentially partially or completely immersed in the water 20; for example, in a situation wherein the operator 210 is struggling to stay afloat, the operator 210 may periodically become submerged in the water 20 and then occasionally appear to the surface of the water 20. Thus, when the operator 210 is potentially struggling to stay afloat, the operator 210 is only intermittently sensed by the one or more sensors 200. Furthermore, when the water 20 is subject to significant wave amplitude and the operator 210 is a relatively greater distance from the one or more sensors 200, such waves potentially obscure a visual path between the operator 210 and the sensors 200. An additional problem is bright sunlight incident upon the surface of the water 20 being reflected towards the one or more sensors 200; such bright sunlight reflections can potentially result in false detections or an absence of detection of the operator 210 in the water 20. A yet further problem, is that other objects may potentially be present in the water 20, for example dolphins, whales and sharks and such like; these other objects are potentially capable of providing false signals which the one of more sensors 200 in cooperation with the control unit 110 are not able to distinguish from signals arising from the operator 210 present in the water 20. A yet further problem is that a skin surface of the operator 210 progressively with time assumes a temperature substantially similar to the surface of the water 20 when the operator 210 is submerged in the water 20 as blood capillaries at the skin surface constrict in response to a normally relatively lower temperature of the water 20 in comparison to air temperature in a region of the vessel 10.

In order to address such aforesaid technical problems in detecting the operator 210 when present in the water 20, the one or more sensors 200 in combination with the control unit 110 are operable to employ advanced signal processing methods as will be elucidated below.

Figure 2:
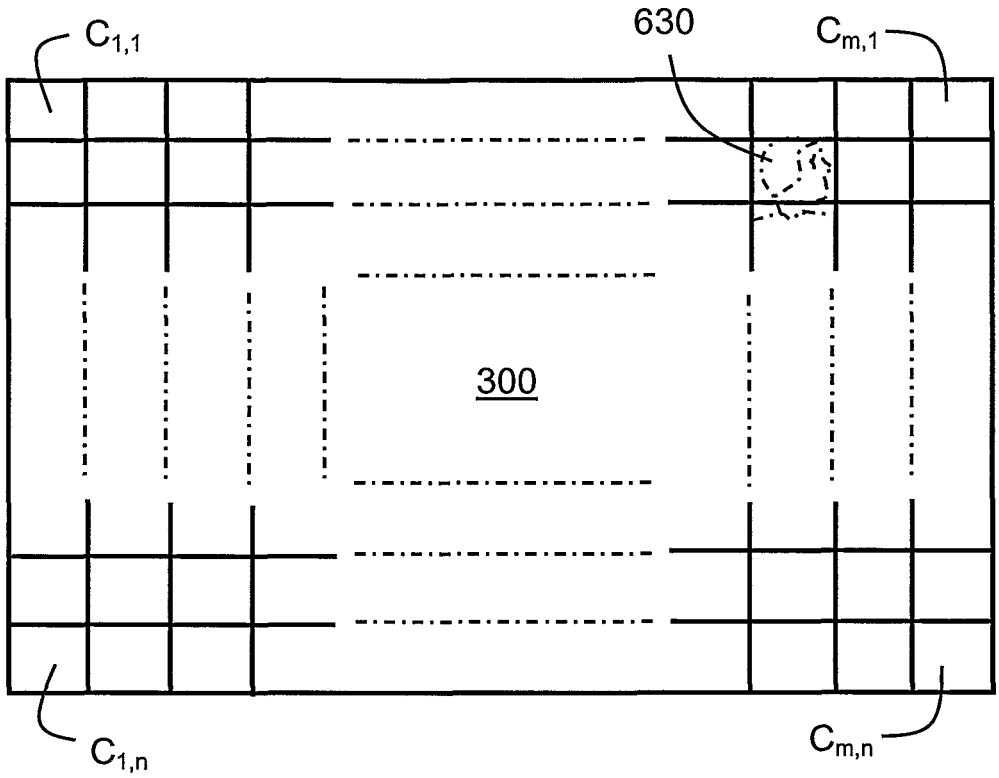
FIG. 2 is an example pixel image layout for one or more sensors of the safety system illustrated in FIG. 1.

The one or more sensors 200 exhibit angular discrimination and have a sufficiently rapid temporal response, for example preferably video rates in a range of 5 to 50 image frames/second. The one or more sensors 200 are beneficially responsive at an infrared (IR) region of the electromagnetic spectrum, namely at electromagnetic radiation wavelengths in a range of 10 μm to 800 μm, and more preferably electromagnetic radiation wavelengths in a range of 5 μm to 1 μm. The one or more sensors 200 are beneficially implemented as pixel devices operable to image a scene including the operator 210 presented to them. Alternatively, in order to image the scene, the one or sensors 200 are implementing as angularly scanned devices operable to scan the scene. The one or more sensors 200 are thus operable in their signals provided to the control unit 110 to map out a pixel image as illustrated in FIG. 2 as presented to the one or more sensors 200 by way of substantially IR radiation. The pixel image is denoted by 300 and includes a top left pixel C1,1, a top right pixel Cm,1, a bottom left pixel C1,n, and a bottom right pixel Cm,n. Thus, the image 300 comprises n by m pixels which, as aforesaid, are beneficially updated at a rate in a range of 5 to 50 image frames/second. The pixels C represent IR intensity sensed from the scene including, for example, the operator 210 in the water 20.

Figure 3:
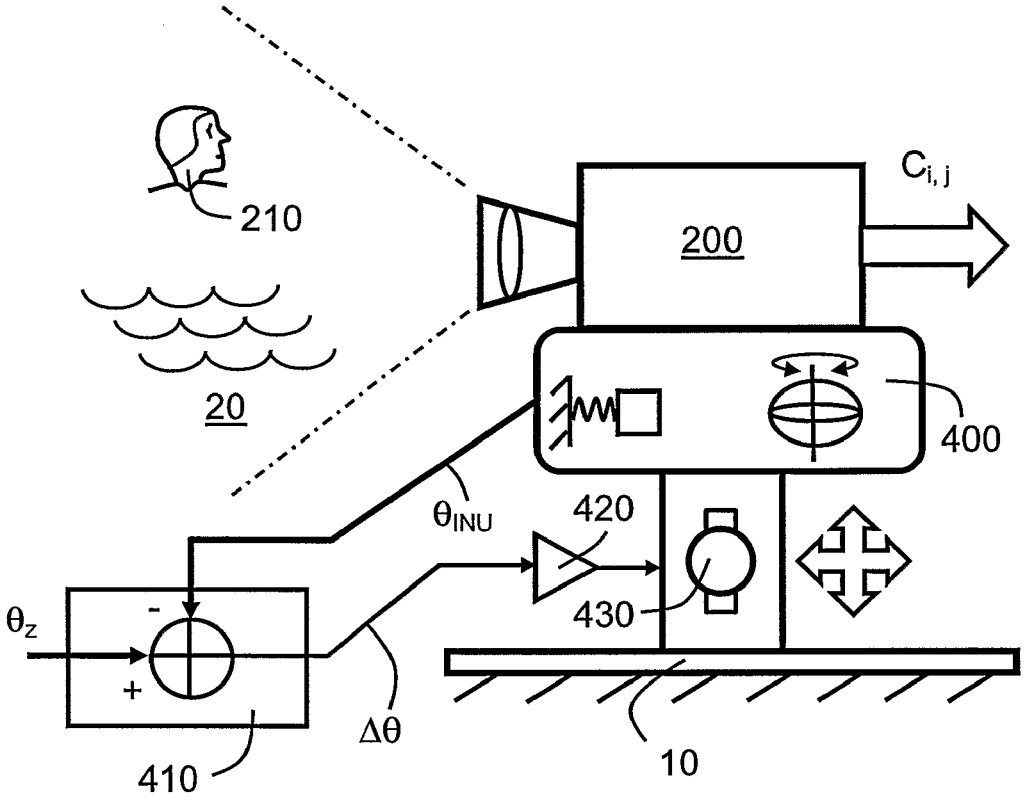
FIG. 3 is an illustration of one of the one or more sensors of FIG. 1 mounted onto an angularly stabilized platform.

In operation, both the vessel 10 and the operator 210 present in the water 20 are moving relatively to one another on account of wave amplitude on the water 20. Beneficially, the one or more sensors 200 are mounted in gyroscopically-stabilized platforms, for example servo-controlled mini-platforms, as depicted in FIG. 3. Alternatively, the one or more sensors 200 are provided with image stabilization based on correlation between consecutive image frames as employed in contemporary hand-held video cameras.

When the one or more sensors 100 are gyroscopically stabilized, a system as depicted in FIG. 3 in beneficially employed to provide such stabilization. In FIG. 3, the sensor 200 is mounted together with an inertial sensing unit 400. Optionally, the inertial sensing unit 400 includes angular turning rate sensors such as vibrating micromachined turning-rate sensors or fibre-optic turning rate sensors. The system of FIG. 3 further includes an angular feedback unit 410 operable to generate a difference error signal δθ from a measured angular position θINU of the sensor 200 and reference angular signal θz. The error signal δθ is coupled via a servo amplifier assembly 420 to a servo-actuator assembly 430, for example a configuration of electro-magnetic actuators, to actuate: the inertial sensing unit 400 and hence the sensor 200. The system of FIG. 3 is capable of keeping the sensor 200 at a stabilized angle relative to the water 20. However, the system of FIG. 3 is not able to account for wave amplitude in the water 20 and the operator 210 effectively floating, namely bobbing, up and down on such waves.

Figure 4:
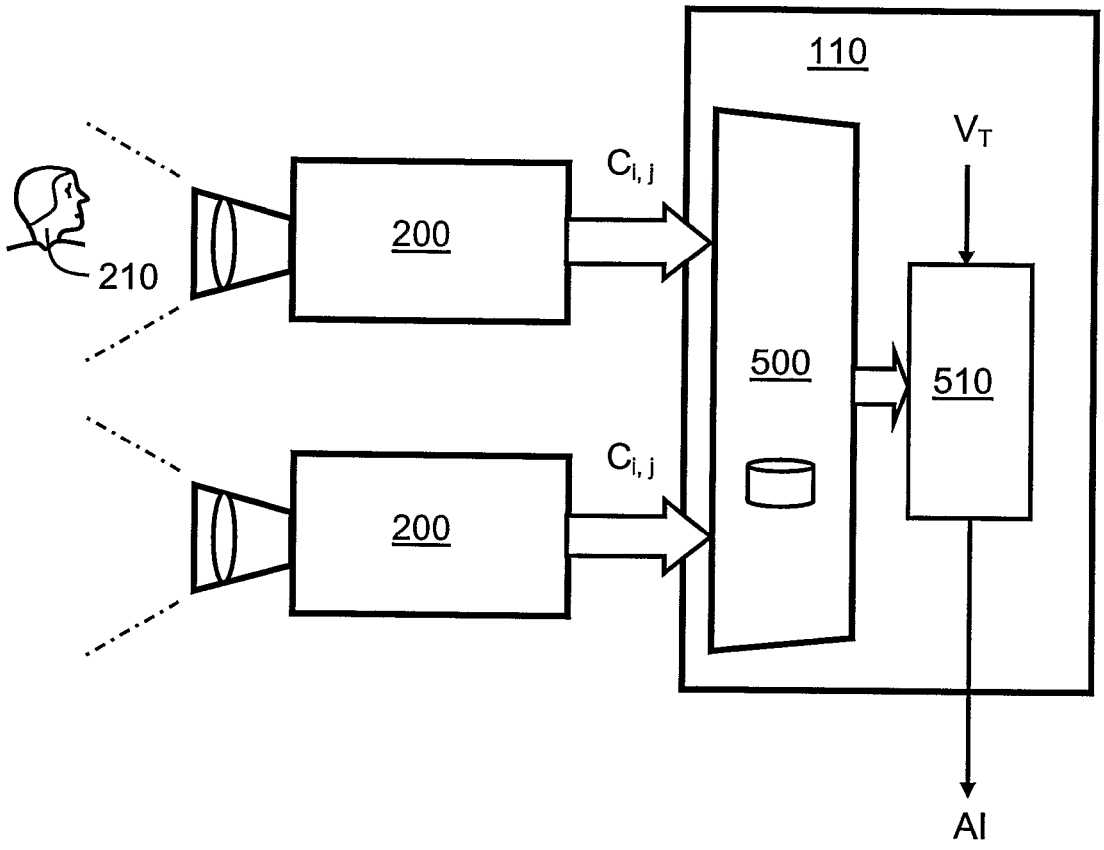
FIG. 4 is an illustration of a signal processing unit of the safety system of FIG. 1, the processing unit operable to perform a form of image processing.

Processing the signals Ci,j generated from the one or more sensors 200 is potentially complex as depicted in FIG. 4. In FIG. 4, the pixel out signals Ci,j are provided to an image buffer 500 of the control unit 110. As elucidated in the foregoing, the control unit 110 is beneficially implemented as a configuration of application specific digital circuits and/or as computing hardware provided with suitable software to execute. The images Ci,j are selectively fed in operation from the buffer 500 and processed in a threshold detection unit denoted by 510. An output AI of the detection unit 510 is indicative of detection of the operator 210, or any other persons, present in the water 20. The detection unit 510 is provided with a threshold detection level denoted by Vτ. The detection level Vτ is beneficially dynamically variable in response to one or more of:

(a) ambient sunlight conditions at the vessel;

(b) periodic occlusion of sunlight by clouds and similar causing IR output from waves on the surface of the water 20 to temporally vary in a vicinity of the vessel 10;

(c) wave amplitude on the surface of the water 20 near the vessel 10; and (d) a duration of time which the operator 210 is presumed to have been present in the water 20.

As elucidated in the foregoing, the surface of the water 20 is, under ideal conditions flat and substantially of zero wave amplitude. However, such a beneficial condition cannot always be guaranteed such that the one or more sensors 200 operating in combination with the control unit 110 need to be able to cope with significant wave amplitude, for example in an order of 1 metre or more swell.

A temporal stream of images for the one or more sensors 200 is conveniently denoted by Ci, j, t wherein parameter t denotes a corresponding time when the image C was generated by each of the sensors 200. The buffer 500 in combination with the detection unit 510 is operable to compute a series of moving averages Mi, j, t, p, q, y as described by Equation 1 (Eq. 1):

$$M_{i,j,t,p,q,y} = \sum_{u=i-p}^{u=i+p} \sum_{v=j-q}^{v=j+q} \sum_{w+t-y}^{w=i+y} C_{u,v,w} \qquad \text{Eq. 1}$$

wherein

Mi, j, t, p, q, y=moving average centred on i, j, t with an averaging region defined by parameters p and q spatially and y temporally.

The moving average M is then subtracted from a longer-term local background Mbk for substantially the same region to generate a difference DM: i, j, t, p, q, y as described by Equation 2 (Eq-2):

$$D_{M:i,j,t,p,q,y} = M_{i,j,t,p,q,y} - M_{bk} \qquad \text{Eq. 2}$$

Beneficially, the background average Mbk is computed also from Equation 1 but with values of the parameters p, q and y considerably greater, for example an order of magnitude greater, than used to compute the moving average Mi, j, t, p, q, y.

the moving average Mi, j, t, p, q, y is computed for various combinations of values of the parameters p, q and y when searching for a signature of the operator 210 present in the water 20; when the difference DMi, j, t, p, q, y consistently exceeds the aforesaid detection level Vτ, the operator 210, or any other person, is deemed to be present within the water 20. The parameters p, q and y are beneficially a least partially selected in value by the control unit 110 in response to prevailing weather conditions and solar illumination to which the vessel 10 is presently exposed for example.

Figure 5:
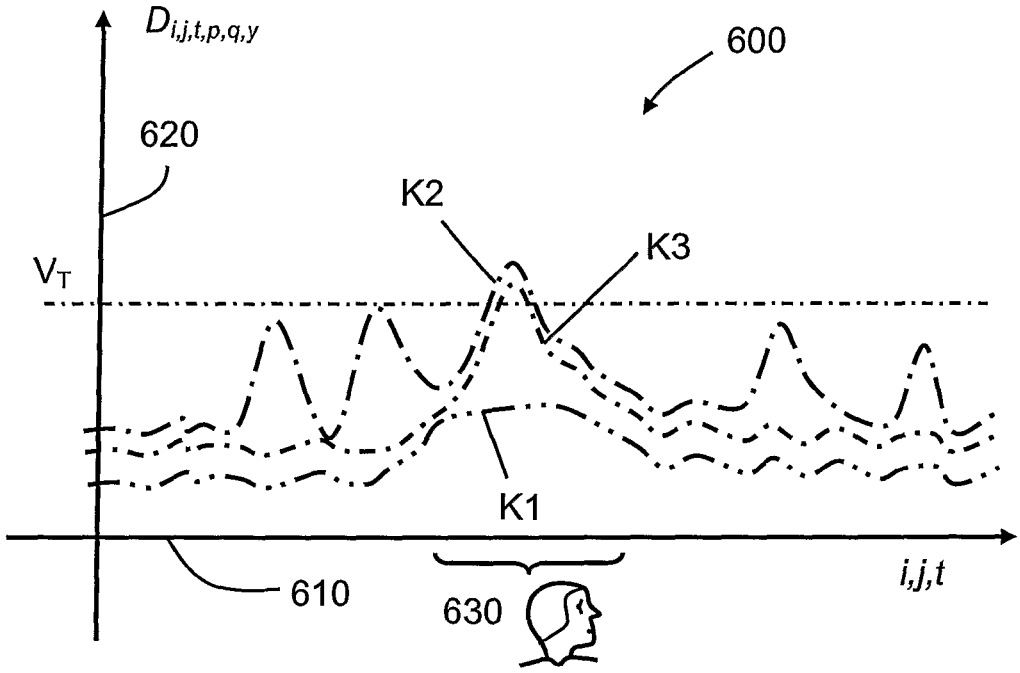
FIG. 5 is a graph illustrating processed signals generated by the processing unit of FIG. 4.

A example; of computation of the difference DMi, j, t, p, q, y is depicted in FIG. 5. In FIG. 5, a graph of the difference DMi, j, t, p, q, y is indicated generally by 600 and includes an abscissa axis 610 denoting the difference computed in a moving manner in respect to one or more of pixel coefficients i, j and image sensing time t. The graph 600 further includes an ordinate axis 620 denoting the aforesaid difference DMi, j, t, p, q, y together with the detection level VT shown. There is shown moving computations of the difference DMi, j, t, p, q, y as denoted by curves K1, K2, K3. The curve K1 corresponds to the control unit 110 applying relative large values of parameters p, q and y comparable to those used to compute the local background average Mbk in consequence, a signature of the operator 210 in the water 20 denoted by 630 is not distinct and also below the detection level Vx. Conversely, in the curve K2, the parameters p, q, and y are made too small so that the difference DMi, j, t, p, q, y is strongly affected by spatial and temporal noise in the signal Cy; for example, intermittent submersion of the operator 210 in the water 20, namely head-underwater, can result in the signature being momentarily reduced. The curve K3 corresponds to a more optimal selection of the parameters p, q and y which results in reliably detection of the operator 210 and exclusion of external interference. If the operator 210 is riding a relatively large wave amplitude in the water 20, parameters p and q need to be increased to accommodate a larger range of potential positions of the operator 210 whilst bobbing about on the water 20. The control unit 110 in calculating such difference DMi, j, t, p, q, y takes into account a number of spurious peaks close to the detection level Vx as well as detecting at least one signature 630. If the signature 630 is not relatively spatially stable, the control unit 110 concludes that there is ho person within its field of view C1,1 to Cm,n.

Optionally, the one or more of the sensors 200 can be under servo control to maintain them pointing towards the operator 210 in the water 20. Moreover, as elucidated in the foregoing, the control unit 110 is operable to compute a spatial difference between the signature 630 and a spatial region around the propellers 70. In an event that the operator 210 swims or is swept by water currents too close to the propellers 70, the control unit 110 is operable to deactivate mechanical drive to the propellers 70. Such safety operation has been described in the foregoing.

Figure 6:
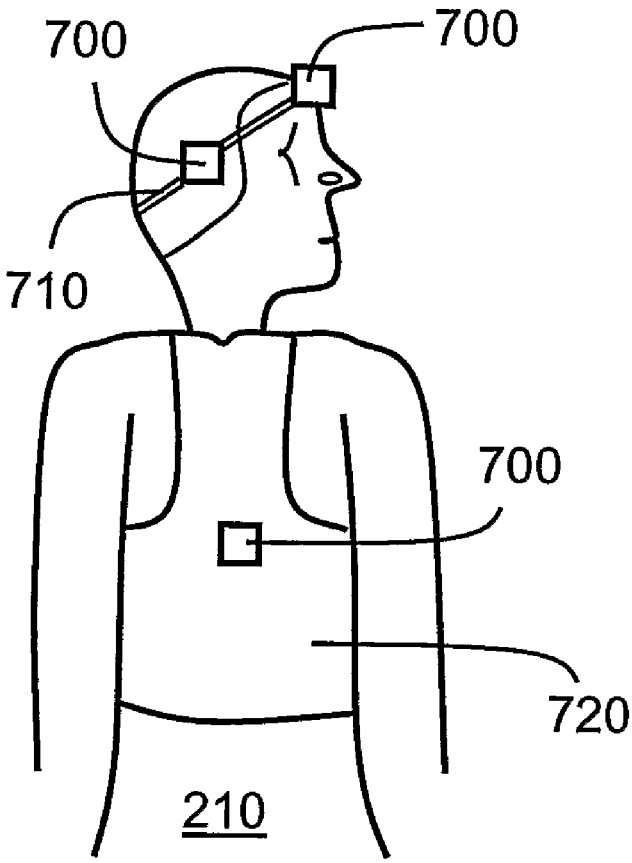
FIG. 6 is an illustration of an operator provided with a head assembly and a life vest equipped with pulsed infra-red sources suitable for use with the safety system illustrated in FIG. 1.

It will appreciated from the foregoing that the vessel 10 with its aforesaid apparatus to detect presence of the operator 210, or other persons if appropriate, ensures more reliable detection of the operator 210 when in the water 20; such detection represents potentially a technical problem which requires special aforementioned signal processing within the control unit 110. In order to increase detection contrast, thereby defining the signature 630 more reliably, the operator 210 is preferably provided with a powered infra red (IR) source 700 strapped thereto, for example to one or more of a head band 710 or to a life vest 720 of the operator 210 as depicted in FIG. 6. Optionally, the IR source 700 is battery operated and activated in contact with the water 20. More optionally, the IR source 700 is pulsed so as to emit IR radiation detectable by the one or more sensors 200 at a frequency susceptible to providing a clearer signature 630 in the control unit 110 when applying the aforementioned image processing of the signal Cy. Yet more optionally, the source 700 is pulsed temporally with a signature code which is well distinguished from random sporadic reflection of sunlight from waves in the water 20, and the control unit 110 is operable to implement a temporal correlation of the signal Ci,j with a copy of the signature code retained at the control unit 110. Optionally, the signature code is itself a form of pseudo-random code.

The operator 210 optionally also is provided with a radio transmitter and the one or more of the sensors 200 are supplemented by radio detectors to increase reliability of detection of the operator 210 in the water 10. Yet more optionally, the one or more sensors 200 are supplemented by audio sensors provided with subsequent audio signal processing to detect shouts from the operator 210 when in the water 20; such audio signal processing is beneficially operable to reject wind noise and, for example, cries from sea gulls and similar aquatic birdlife.

Modifications to embodiments of the invention described in the foregoing are possible without departing from the scope of the invention as defined by the accompanying claims.

Expressions such as "including", "comprising", "incorporating", "consisting of, "have", "is" used to describe and claim the present invention are intended to be construed in a nonexclusive manner, namely allowing for items, components or elements not explicitly described also to be present. Reference to the singular is also to be construed to relate to the plural.

Numerals included within parentheses in the accompanying claims are intended to assist understanding of the claims and should hot be construed in any way to limit subject matter claimed by these claims.

The invention claimed is:

1. A safety system for a marine vessel, the vessel including one or more engines coupled to one or more propellers for propelling the vessel through water, and the vessel being provided with a digital anchor in communication with the one or more engines for maintaining the vessel substantially at a defined location when the anchor is activated, wherein the safety system includes a sensor assembly coupled to a data processing assembly for sensing a region of the water at least partially surrounding the vessel for detection of one or more persons present in the region and for modifying operation of the digital anchor is response to the one or more persons being detected, wherein the sensor assembly includes one or more infra red sensors for detecting infra red radiation generated by the one or more persons when present in the region of the water, wherein each of the one or more infra red sensors are scanned and/or pixellated image sensors operable to generate an output signal for receipt at the data processing assembly representative of a spatial image of at least a portion of the region of water.

2. A safety system as claimed in claim 1, wherein the system is operable to respond to the detection of the one or more persons by one or more of:

(a) deactivating the digital anchor;

(b) operating the engines so as to maintain the vessel in a proximity of the one or more persons; and (c) deactivating drive to the engines in an event that the one or more persons are closer to the propellers than a threshold distance.

3. A safety system as claimed in claim 1, wherein the one or more sensors are responsive in an electromagnetic radiation wavelength range of substantially 10 μm to 800 μm.

4. A safety system as claimed in claim 1, wherein the one or more sensors are angularly stabilized for rendering the output signal is compensated for angular movement of the vessel relative to the water.

5. A safety system as claimed in claim 4, wherein the one or more sensors are mounted on one or more gyroscopically angularly stabilized servo-platforms.

6. A safety system as claimed in claim 1, wherein the data processing assembly is provided with computing hardware for computing a moving average for each spatial region of the image and for detecting differences in the moving average for detecting the presence of the one or more persons within the region of water.

7. A safety system as claimed in claim 6, wherein the differences are compared with a threshold value for determining detection of the one or more persons in the region of water.

8. A safety system as claimed in claim 7, wherein the processing assembly is operable to vary the threshold value in response to one or more of:

(a) solar irradiation onto the vessel and the region of water surrounding the vessel;

(b) amplitude of wave motion in the region of water;

(c) wind speed at the vessel; and (d) temperature of the region of water.

9. A safety system as claimed in claim 6, wherein the processing assembly is operable to compute the moving average with spatial averaging and/or temporal averaging which is varied in response to one or more of:

(a) solar irradiation onto the vessel and the region of water surrounding the vessel;

(b) amplitude of wave motion in the region of water;

(c) wind speed at the vessel; and (d) temperature of the region of water.

10. A safety system as claimed in claim 1 wherein each of the one or more persons are provided with one or more pulsed infra red sources attached thereto, the pulsed infra red sources being operable in water to emit pulsed infra red radiation bearing a signature code which is detectable at the one or more sensors and subsequently correlatable at the signal processing assembly to provide for more reliable detection of the one or more persons present in the region of water.

11. A safety system as claimed in claim 10, wherein the one or more pulsed infra red sources are automatically activated in response to contact with the water.

12. A life vest attachable to a person, the vest for use with the safety system as claimed in claim 1, the vest including one or more pulsed infra red sources attached thereto, the pulsed infra red sources being operable in water to emit pulsed infra red radiation bearing a signature code which is correlated at the signal processing assembly to provide for more reliable detection of the one or more persons present in the region of water.

13. A head assembly attachable to a person, the head assembly for use with the safety system as claimed in claim 1, the head assembly including one or more pulsed infra red sources attached thereto, the pulsed infra red sources being operable in water to emit pulsed infra red radiation bearing a signature code which is correlated at the signal processing assembly to provide for more reliable detection of the one or more persons present in the region of water.

14. A method of detecting one or more persons present in a region of water at least partially surrounding a vessel, the vessel including one or more engines coupled to one or more propellers for propelling the vessel through water, and the vessel being provided with a digital anchor in communication with the one or more engines for maintaining the vessel substantially at a defined location when the anchor is activated, wherein the method includes steps of (a) using a sensor assembly coupled to a data processing assembly for sensing the region of the water for detecting one or more persons present in the region; and (b) modifying operation of the digital anchor is response to the one or more persons being detected by the data processing assembly, wherein the sensor assembly includes one or more infra red sensors for detecting infra red radiation generated by the one or more persons when present in the region of the water, and wherein each of the one or more infra red sensors are scanned and/or pixellated image sensors operable to generate an output signal for receipt at the data processing assembly representative of a spatial image of at least a portion of the region of water.

15. A method as claimed in claim 14 including a step of responding to the detection of the one or more persons by one or more of:

(a) deactivating the digital anchor;

(b) operating the engines so as to maintain the vessel in a proximity of the one or more persons; and (c) deactivating drive to the engines in an event that the one or more persons are closer to the propellers than a threshold distance.

16. A method as claimed in claim 14, wherein the one or more sensors are responsive in an electromagnetic radiation wavelength range of substantially 10 μm to 800 μm.

17. A method as claimed in claim 14, wherein the one or more sensors are angularly stabilized for rendering the output signal compensated for angular movement of the vessel relative to the water.

18. A method as claimed in claim 17, wherein the one or more sensors are mounted on one or more gyroscopically angularly stabilized servo-platforms.

19. A method as claimed in claim 14, wherein the data processing assembly is provided with computing hardware for computing a moving average for each spatial region of the image and for detecting differences in the moving average for detecting the presence of the one or more persons within the region of water.

20. A method as claimed in claim 19, wherein the differences are compared with a threshold value for determining detection of the one or more persons in the region of water.

21. A method as claimed in claim 20, wherein the processing assembly is operable to vary the threshold value in response to one or more of:

(a) solar irradiation onto the vessel and the region of water surrounding the vessel;

(b) amplitude of wave motion in the region of water;

(c) wind speed at the vessel; and (d) temperature of the region of water.

22. A method as claimed in claim 19, wherein the processing assembly is operable to compute the moving average with spatial averaging and/or temporal averaging which is varied in response to one or more of (a) solar irradiation onto the vessel and the region of water surrounding the vessel;

(b) amplitude of wave motion in the region of water;

(c) wind speed at the vessel; and (d) temperature of the region of water.

23. A method as claimed in claim 14, the method including steps of:

(a) providing each of the one or more persons with one or more pulsed infra red sources attached thereto, the pulsed infra red sources being operable in water to emit pulsed infra red radiation bearing a signature code detectable at the one or more sensors; and (b) correlating at the signal processing assembly the received signature code received from the one or more pulsed infra red sources to provide for more reliable detection of the one or more persons present in the region of water.

24. A method as claimed in claim 23, wherein the one or more pulsed infra red sources are automatically activated in response to contact with the water.

25. A non-transitory software product executable on computing hardware to implement a method as claimed in claim 14.

* * * * *